United States Patent [19]

Dembicks

[11] 4,410,095

[45] Oct. 18, 1983

[54] INTERLOCKING MODULAR ARTICLE SUPPORTING SYSTEM AND COMPONENT UNITS THEREFOR

[75] Inventor: Andrew E. Dembicks, Raleigh, N.C.

[73] Assignee: Southern Case, Inc., Raleigh, N.C.

[21] Appl. No.: 204,297

[22] Filed: Nov. 5, 1980

[51] Int. Cl.[3] ..... A47F 5/08

[52] U.S. Cl. ..... 211/60 T; 211/87; 248/220.2; 248/225.1

[58] Field of Search ..... 211/60 T, 60 R, 87, 211/75, 71; 248/558, 220.1, 220.2, 220.3, 220.4, 221.1, 221.2, 222.4, 225.1

[56] References Cited

U.S. PATENT DOCUMENTS

| | | | |
|---|---|---|---|
| 944,312 | 7/1909 | Brede . | |
| 2,371,433 | 3/1945 | Davis | 211/60 T |
| 2,762,595 | 9/1956 | Jenne | 248/225.1 |
| 3,269,550 | 10/1966 | Marcus . | |
| 3,452,954 | 7/1969 | Lucietto et al. | 248/221.1 |
| 3,581,929 | 4/1969 | Guenard et al. | 211/60 R X |
| 4,049,126 | 6/1977 | Halverson . | |
| 4,199,070 | 3/1980 | Magnussen, Jr. . | |

FOREIGN PATENT DOCUMENTS

| | | | |
|---|---|---|---|
| 2619151 | 11/1977 | Fed. Rep. of Germany | 211/60 T |
| 1049697 | 12/1953 | France | 211/60 T |

*Primary Examiner*—Ramon S. Britts
*Assistant Examiner*—Robert W. Gibson, Jr.
*Attorney, Agent, or Firm*—Bell, Seltzer, Park & Gibson

[57] ABSTRACT

This invention is an interlocking article supporting system which is add-on in character and is designed to accommodate a wide variety of tools and similar articles. The system is primarily a hanging system with provision for adding additional units without modification. The system is structurally strong and yet simple and uncomplicated to assemble and mount. This system can be used for wall mounting or mounting on pegboard and similar adaptations.

21 Claims, 7 Drawing Figures

FIG. 3
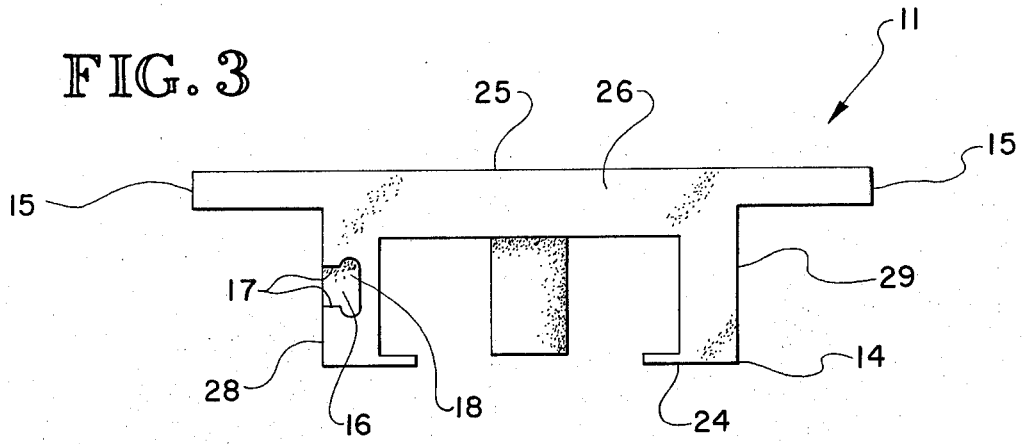
FIG. 4
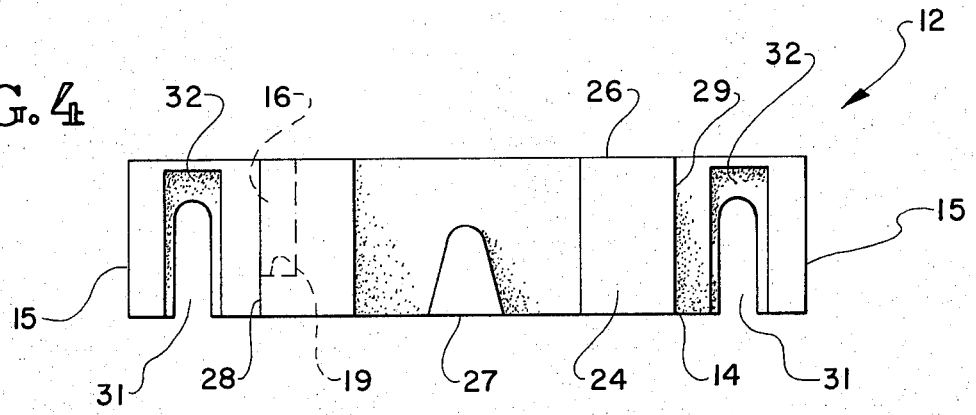
FIG. 5
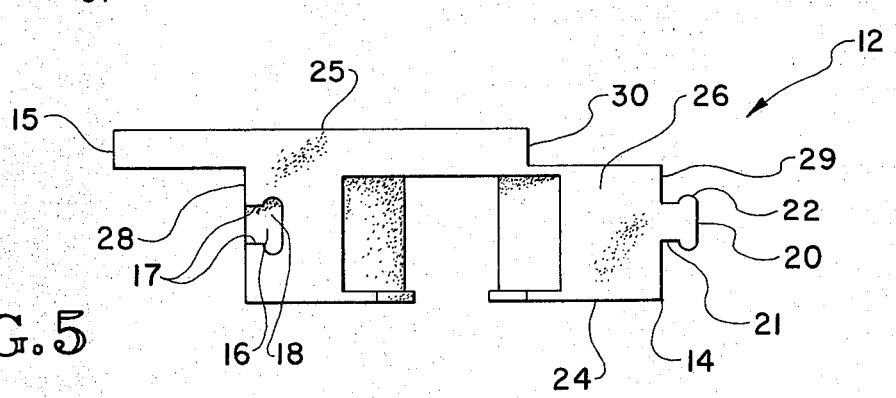
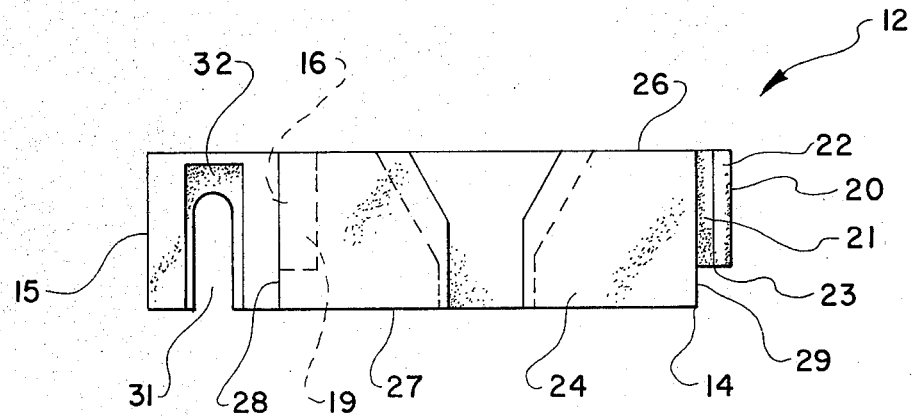
FIG. 6

INTERLOCKING MODULAR ARTICLE SUPPORTING SYSTEM AND COMPONENT UNITS THEREFOR

FIELD OF INVENTION

This invention relates to support means and more particularly a supporting system for articles.

BACKGROUND OF INVENTION

In the past various systems have been devised in an effort to allow tools and other articles to be suspended or held in place in an orderly fashion. Various types of brackets and holders have been devised for specialized purposes such as suspending brooms, mops, and the like. Also systems such as peg boards have been developed for this purpose with various shapes and sizes of supporting hooks being available for use therewith. In each of these various systems, problems are encountered by there being either specifically designed for a particular article which limits widespread or universal use or such a large variety of various components must be readily available that practicality is questionable at best.

BRIEF DESCRIPTION OF INVENTION

After much research and study into the above-mentioned problems, the present invention has been developed to provide a system of interlocking blocks for supporting various types of tools and other articles with unlimited add-on capabilities. Only a limited variety of article engaging configurations are required to support an extremely large variety of varying shaped articles. With minor modification, the system of the present invention can be readily adapted to standard peg board type installation which would greatly broaden the versatility of this type of tool and article organizing means.

In view of the above, it is an object of the present invention to provide a simple, inexpensive and yet highly efficient article supporting system.

Another object of the present invention is to provide an article supporting system which has unlimited add-on capabilities.

Another object of the present invention is to provide an article supporting system whereby a variety of different configured support means can be readily substituted or added.

Another object of the present invention is to provide an article support system with a plurality of interlocking support members.

Another object of the present invention is to provide a support means for articles wherein each add-on part includes its own support station wholly contained within the dimensions of the part.

Another object of the present invention is to provide an article support system with a unique interlocking means for a plurality of separable units.

Another object of the present invention is to provide an interlocking article support system through the use of only two basic configurations to obtain any desired odd or even number of article support stations.

Another object of the present invention is to provide a tool and article supporting system which can be used with either a peg board type support or an against-the-wall type support.

Another object of the present invention is to provide an interlocking article support system for use in conjunction with peg board which, with the simple removal of a molded projection, the same can be used in conjunction with any flat wall type surface.

Other objects and advantages of the present invention will become apparent and obvious from a study of the following description and the accompanying drawings which are merely illustrative of such invention.

BRIEF DESCRIPTION OF DRAWINGS

FIG. 3 is a top plan view of a typical end support unit;

FIG. 4 is a front elevational view of the unit shown in FIG. 3;

FIG. 5 is a top plan view of another typical add-on unit;

FIG. 6 is a front elevational view of the unit shown in FIG. 5; and

DETAILED DESCRIPTION OF INVENTION

Figure 1:
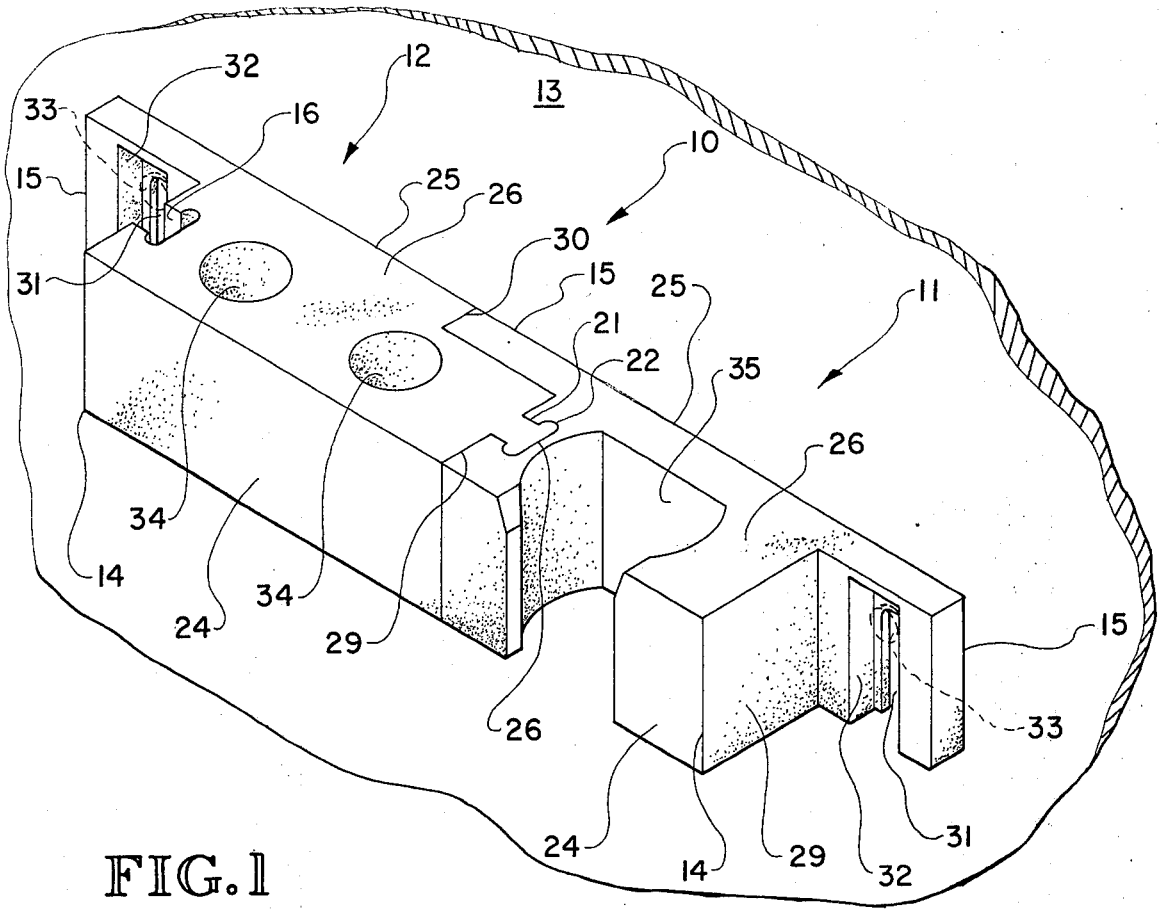
FIG. 1 is a perspective view of the interlocking article supporting system of the present invention showing different article holding configurations.

With further reference to the drawings, the support system of the present invention, indicated generally at 10, is made up of two basic types of component units, namely, an end unit indicated generally at 11 and add-on unit indicated generally at 12. The main difference between the two units is that the end unit 11 has at least two mounting portions whereas the add-on units have only one. The purpose of these differences will become more apparent from the following description.

Each of the illustrated component units includes a body 14 having opposed ends 28 and 29. Body 14 defines an article or tool support station and, in the drawings, each body is shown to include at least one mounting portion 15. As discussed below, the component units are interlocked end to end to form system 10.

Disposed at ninety degrees to and formed in one side of the body 14 is a female opening in the form of a slot 16 having a constricted or throat area 17 and an enlarged inner area 18. This slot has a bottom 19 thus only passing through approximately three-quarters of the thickness of the support portion.

The slots 16 as described above are provided on the same end of body 14 of each of the units 11 and units 12. The purpose of this will become more apparent from the following description.

Each of the add-on units 12 is provided with a slot engaging interlock projection 20. This interlock projection includes a constricted portion 21 and an enlarged or bulbous portion 22. As can clearly be seen from the Figures, particularly FIG. 5, the exterior configuration of interlock projection 20 and the interior configuration of slot 16 are matching. The interlock projection 20 extends only approximately three-fourths the thickness of its support portion respective body 14 as can clearly be seen in FIGS. 2 and 6 with the bottom 23 of such interlock projection coinciding with bottom 19 of slot 16.

As illustrated and described, the opposed ends of adjacent units of the system include matching interlock projections 20 and slots 16 that define cooperative, mating interference fit means for interlocking the adjacent units by sliding interference fit. Further, the engagement of slot bottom 19 and interlock projection bottom 23 defines stop means for establishing the full extend of the sliding interference fit and thereby establishing the desired continuity of the exterior of the system from unit to unit. The bodies of the component units forming system 10 have substantially flat front surfaces that are joined to present a substantially continuous front face of the system suitable for bearing indicia for tool identification, trademark indicia, or the like.

For the purpose of this description only and to describe the support system and its parts as oriented in the drawings, each of the units will be described as having a front 24, rear 25, top 26, and bottom 27.

The rear 25 of each of the add-on units 12 includes an outwardly disposed, wing-like mounting portion 15 on the left side 28 and a corresponding notch portion 30 on the right side other end 29. As the units are connected together as shown in FIG. 1, the wing-like mounting portion 15 will conformingly engage the notch portion 30 of the adjacent unit of the support system. This is not only aesthetically gives a continuous configuration, but with the interlock projection 20 of one unit engaging the slot 16 of the adjacent unit, a rigid connection is formed through both the interlocking of these parts and the tight engagement of the notch 30 and mounting portion 15 of such adjacent units.

Each of the mounting portions 15 of the various units 11 and 12 includes an elongated, generally U-shaped mounting slot 31. These slots are recessed in rectangular opening 32 as can be seen in the various Figures, particularly in the perspective view of FIG. 1.

Each of the mounting slots 31 are adapted to supportingly engage a nail, screw, or other similar exterior means 33 outwardly projecting from primary support wall or similar surface 13 and having a head portion slightly larger than slot 31 and a body portion slightly smaller than the same.

Thus it can be seen that each of the end units 11 with its mounting portion 15 on each side thereof is self-contained in that two mounting slots 31 are provided, one on each end thereof. As additional units are added, one end thereof is supported by the interlocking of projection 20 and slot 16 while the opposite end is supported by the mounting slot 31 provided in the single, wing-like mounting portion 15 thereof.

From the above it becomes obvious that only one end unit 11 is needed with an infinite number of add-on units 12 being connectable thereto.

Figure 2:
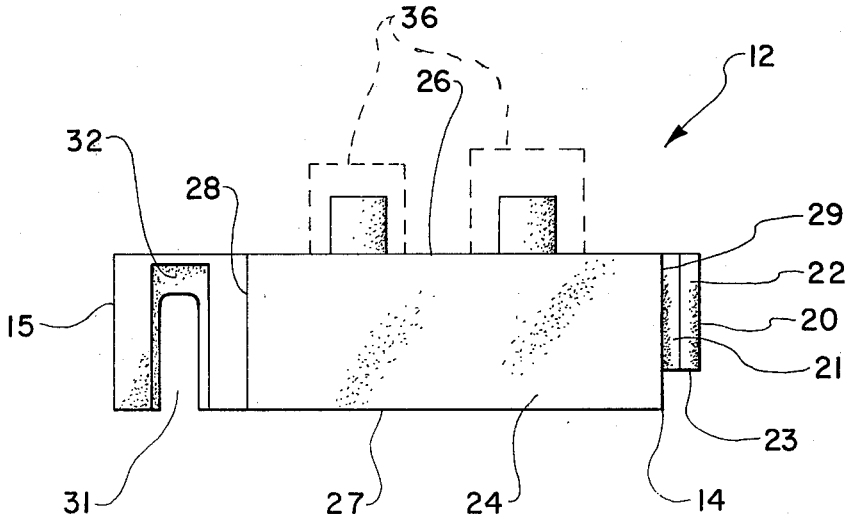
FIG. 2 is a front elevational view of an add-on unit having an even different article holding configuration.
Figure 7:
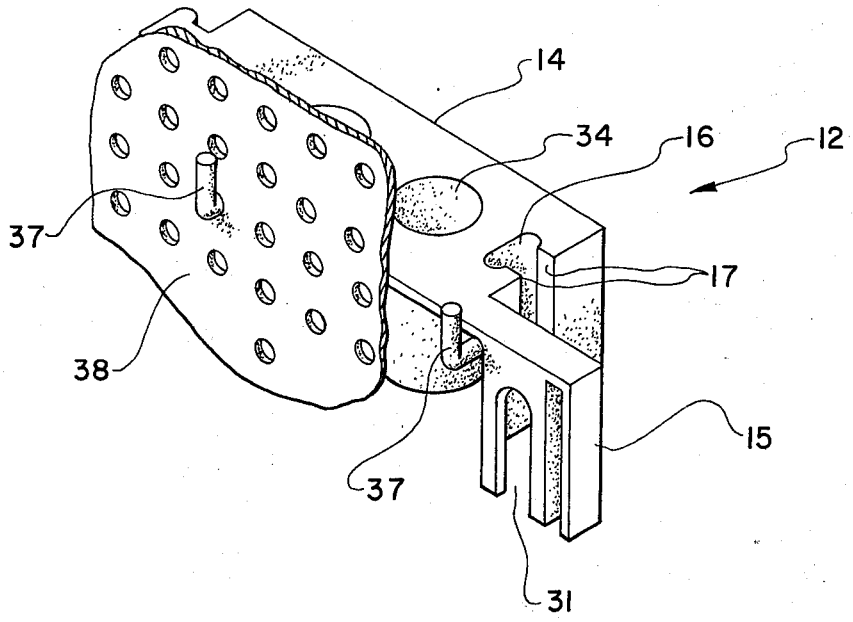
FIG. 7 is a partially cutaway perspective view of one component unit of the system of the present invention mounted on a pegboard type support means.

Since various tools require various configurations to mount the same, a plurality of cylindrical openings 34 can pass through the article support station for mounting screw drivers and the like as seen in FIGS. 1 and 7; a generally U-shaped, slot-like opening 35 can be provided for lathe tools, and the like as seen in FIG. 1; cylindrical projections on the upper or top portion 26 can be provided for holding sockets 36 used in conjunction with socket wrenches or the like as seen in FIG. 2; a central, hump-shaped projection within a U-shaped slot can be provided for receiving pliers and similar articulated tools as seen in FIGS. 3 and 4; and a tapered, Y-shaped slot for mounting box wrenches can be provided as shown in FIGS. 5 and 6. As described and illustrated, the article support stations are wholly contained within the dimensions of their respective units, with each article support station having a configuration and dimensions suitable to receive, guide and orient an article into a suitable position for support by the station.

It is, of course, envisioned that many other different configurations can be provided for the tool and other articles supported by portion 14 of the various units 11 and 12 and certainly the present invention is not intended to be limited to the configurations shown since these are for illustrative purposes only.

Appropriately configured add-on units 12 can be packed with various goods so that the purchaser can simply add-on the additional unit or units to his present support system without having to make a separate purchase to acquire the same.

Since many shops and other areas presently have pegboards with their multitude of various shaped hooks, the present invention can be molded with an upturned, arm-like member 37 on or adjacent the rear 25 of each of the mounting portions 15 of units 11 and 12. These upturned, arm-like members are spaced on the same centers as the openings in standard pegboard and can be passed through such openings to mount the system of the present invention thereon. Should the user not desire to mount the units on pegboard, then arms 37 can simply be cut off with a knife and the rear 25 of the unit is back to the standard configuration shown in FIGS. 1 through 6.

To use the system of the present invention, slots 31 of the two mounting portions 15 of unit 11 are slipped over exterior means 33 to mount the same. As additional units 12 are desired to be added, additional nails, screws or similar exterior means 33 are appropriately spaced in the wall or other surface 13 and such add-on unit or units snugly slipped down with interlocking projection 20 engaging slot 16 while at the same time slot 31 of mounting portion 15 engages projection 33. This process can be repeated as many times as it is desired to add additional units 12.

It should be noted that, as with end unit 11 mounted by itself, regardless of how many add-on units 12 are used, a wing-like mounting portion 15 will always be provided on each end of the article support system as can clearly be noted from a study of FIG. 1.

Whenever it is desired to remove or substitute one add-on unit for another, it is simply moved upwardly out of engagement with its adjacent unit and projection 33 and the substitute unit slipped downwardly in its place.

If a plurality of identical article holding configurations are desired, one unit can be provided with an odd number of configurations and a second unit provided with an even number of configurations and thereafter any desired number of odd or even can be provided by simply adding additional units. This is of particular value when sets of tools or similar articles are being supported such as screw driver sets, or the like.

From the above, it can be seen that the present invention provides a simple, inexpensive and yet highly effective means for mounting tools of various types and configurations. The units are simple to interlock and disconnect and the mounting and dismounting of the entire system is simple and efficient.

The terms "top", "bottom", "front", "rear" and so forth have been used herein merely for convenience to describe the support system and its parts as oriented in the drawings. It is to be understood, however, that these terms are in no way limiting to the invention since the system may obviously be disposed in many different orientations when in use.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A modular article supporting system comprising a plurality of interlocked component units;

each said component unit including a body having opposed ends;

said units being interlocked end to end to form said system;

the opposed ends of adjacent units including cooperative, mating interference fit means for interlocking the adjacent units by sliding interference fit;

the body of at least some of said component units including an article support station wholly contained within the dimensions of its respective unit, said article support station having a configuration and dimensions suitable to receive, guide and orient an article into a suitable position for support by said support station; and at least some of said component units including a mounting portion for facilitating the mounting of said system to a primary support.

2. A modular article supporting system as claimed in claim 1 including stop means associated with said interference fit means for establishing the full extent of sliding of the interference fit and thereby establishing the desired continuity of the exterior of the system from unit to unit.

3. A modular article supporting system as claimed in claim 1 wherein said mounting portion included on at least some of the component units takes the form of an outwardly projecting wing-like mounting portion extending from an end of the unit.

4. A modular article supporting system as claimed in claim 3 wherein units of said system positioned adjacent to said wing-like mounting portions include notches formed in the body of such units, said notches conformingly engaging and concealing the wing-like mounting portions of adjacent units.

5. A modular article supporting system as claimed in claim 4 wherein the component units of said system comprise an end unit and at least one add-on unit, said end unit including a wing-like mounting portion at each end thereof and said at least one add-on unit including a wing-like mounting portion at only one end thereof.

6. A modular article supporting system as claimed in claim 2 wherein said interference fit means at the opposed ends of adjacent units comprises a slot formed at the end of one unit and an interlock projection formed at the end of the other unit, and wherein said stop means comprises boundaries of said slot and interlock projection that determine the full extent to which the interlock projection may extend into the slot.

7. A modular article supporting system as claimed in claim 6 wherein said slot and interlock projection are disposed perpendicular to the unit ends.

8. A modular article supporting system as claimed in claim 6 wherein said slot and interlock projection extend vertically in the normal operative orientation of said system.

9. A modular article supporting system as claimed in claim 6 wherein the interior configuration of said slot and the exterior configuration of said interlock projection are matching, said slot in cross section having a throat and an enlarged inner area and said interlock projection in cross-section having a constricted portion and an enlarged bulbous portion.

10. A modular article supporting system as claimed in claim 1 wherein the bodies of the units forming said system have substantially flat front surfaces that are joined to present a substantially continuous front face of said system suitable for bearing indicia for tool identification, trademark information, or the like.

11. A modular article supporting system as claimed in claim 1 wherein at least some of said units include at least one downturned, arm-like member for supportive engagement with a pegboard type structure.

12. A modular article supporting system as claimed in claim 1 wherein at least some of said article support stations comprise at least one hole extending vertically through the body of the respective unit as such unit is oriented in its normal operative position.

13. A component unit for a modular article supporting system, said component unit comprising:

a body having first and second opposed ends;

said body including an article support station wholly contained within the dimensions of said unit and having a configuration and dimensions suitable to receive, guide and orient an article into a suitable position for support by said support station;

said first end including a female opening having an interior configuration; and said second end including interlock projection means having an exterior configuration matching the interior configuration of said opening for interlocking said unit to an adjacent unit of a modular system by sliding interference fit of the projection means into the opening of the adjacent unit.

14. A component unit as claimed in claim 13 including stop means associated with said opening and interlock projection means for establishing the full extent of the sliding of the interference fit.

15. A component unit as claimed in claim 13 wherein said unit is an end unit having a mounting portion at each end thereof.

16. A component unit as claimed in claim 13 wherein said unit is an add-on unit having a mounting portion at only one end thereof.

17. A component unit as claimed in claim 13 including:

an outwardly projecting wing-like mounting portion extending from one of said ends for facilitating the mounting of the unit to a primary support; and notch means formed in said body and extending inwardly from the end opposite said mounting portion for conformingly engaging and concealing the wing-like mounting portion of an adjacent unit of a modular system.

18. A component unit as claimed in claim 13 including at least one downturned arm-like member attached to said unit for supportive engagement with a pegboard structure.

19. A component unit as claimed in claim 13 wherein said support station comprises at least one hole extending vertically through the body of the unit as such unit is oriented in its normal operative position.

20. A modular article supporting system comprising a plurality of interlocked component units;

each said component unit including a body having opposed ends;

said units being interlocked end to end to form said system;

the opposed ends of adjacent units including cooperative, mating interference fit means for interlocking the adjacent units by sliding interference fit, said interference fit means comprising a female opening at the end of one of the adjacent units and an interlock projection formed at the end of the other adjacent unit, the interior configuration of said opening matching the exterior configuration of said interlock projection;

the opposed ends of adjacent units further including cooperative mounting means for facilitating the mounting of said system to a primary support, said mounting means including an outwardly projecting wing-like mounting portion extending from one of the adjacent units and a notch formed in the body of the other adjacent unit, said notch conformingly engaging and concealing the wing-like mounting portion;

stop means associated with said interference fit means for establishing the full extent of sliding of the interference fit and thereby establishing the desired continuity of the exterior of the system from unit to unit; and the body of at least some of said component units including an article support station wholly contained within the dimensions of its respective unit, said article support station having a configuration and dimensions suitable to receive, guide and orient an article into a suitable position for support by said support station.

21. A modular article supporting system as claimed in claim 20 where the bodies of the units forming said system have substantially flat front surfaces that are joined to present a substantially continuous front face of said system suitable for bearing indicia for tool identification, trademark information, or the like.

* * * * *